United States Patent [19]

Abed

[11] Patent Number: 4,690,397

[45] Date of Patent: Sep. 1, 1987

[54] MECHANICAL HORSE FOR CHILDREN'S PLAY

[76] Inventor: Kamel Ben Y. Abed, Yarka Village 24967, Israel

[21] Appl. No.: 812,952

[22] Filed: Dec. 24, 1985

[30] Foreign Application Priority Data

Mar. 7, 1985 [IL] Israel ..... 74531

[51] Int. Cl.[4] ..... A63G 17/00

[52] U.S. Cl. ..... 272/53.2

[58] Field of Search ..... 272/52, 52.5, 53.1, 272/53.2

[56] References Cited

U.S. PATENT DOCUMENTS

| | | | |
|---|---|---|---|
| 41,570 | 2/1864 | Crandall | 272/52 |
| 1,553,520 | 9/1925 | Dougherty | 272/52 |
| 2,477,504 | 7/1949 | Varnum | 272/53.2 |
| 2,478,091 | 8/1949 | Dwyer | 272/53.2 |
| 2,743,104 | 4/1956 | Dodson | 272/53.1 |
| 3,423,085 | 1/1969 | Koller et al. | 272/53.2 |

*Primary Examiner*—Robert A. Hafer
*Assistant Examiner*—D. Neal Muir
*Attorney, Agent, or Firm*—Frishauf, Holtz, Goodman & Woodward

[57] ABSTRACT

A children's toy in the form of a rocking horse consists of a part in the shape of the hindlegs fixed to the floor, and a rocking part in the shape of the rump, the head and the forelegs pivotally attached at its rear end to the top of the hindlegs. A guide bar provided with two adjustable stops is attached to the tail end of the rump and is slidingly attached to a point on the hindlegs. It limits the angular movement of the rocking part by means of the two stops. A pendulum is suspended in a bearing on the back of the animal, the lower ends of which are weighted. The child, by his body movements, moves the pendulum to and fro, thereby changing the position of the center of gravity of the pivoted part and rocking it up and down.

8 Claims, 2 Drawing Figures

MECHANICAL HORSE FOR CHILDREN'S PLAY

BACKGROUND OF THE INVENTION

The invention relates to a toy in the shape of a horse or another animal such as a donkey, an elephant or the like, which is rocked about a stationary pivot by a weighted pendulum actuated by the feet of a child seated on the animal.

Although all kinds of animals may represent the toy of the present invention, in the following the expression "rocking horse" will mostly be employed to designate any kind of animal which may be incorporated in the toy.

The known rocking horses are generally in the form of a toy horse mounted on curved rockers and adapted to be rocked to and fro by the forward and rearward motion of the child's body. Another kind of rocking horse comprises a play-horse mounted on springs, again rocked by the motion of the child.

Also known are mechanically operated and rocked animals of various kinds, which are generally provided with a swinging or rocking motion by electric means with the aid of cranks and levers.

The present rocking horse differs from the known toys in that the rocking motion is obtained by a change of the position of the center of gravity of the horse by the shifting of a weight or weights in relation to the fixed center of gravity of the rump of the animal.

SUMMARY OF THE INVENTION

The rocking horse of the invention comprises a stationary part preferably bolted to the ground, a rocking part pivotally attached to the stationary part, a weighted pendulum pivotally attached to the rocking part, and a guide bar connecting the stationary and the rocking part and provided with adjustable, resilient stops adapted to limit the angular motion of the rocking part. In a preferred embodiment of the invention the stationary part is in the form of the hindlegs of the horse, while the rocking part containing the rump with a saddle seat attached to its back, the head and the forelegs, a common pivot connecting the rear end of the rump to the top end of the hindlegs.

The guide bar is pivotally attached to the tail end of the rump and is guided in a perforated portion of the stationary part, one adjustable stop and one helical spring being mounted on the bar on each side of the perforated portion.

The pendulum consists of a central, upper part which is hingedly held in a pivot on the back of the animal, and two downwardly extending parts to which one heavy weight each is attached. The child in the saddle can swing the weights in forward and rearward direction, thereby changing the position of the center of gravity of the rocking part and rocking the horse against the retaining force of the helical springs.

A cross bar is preferably provided on top of the rump serving as grip for the child's hands.

The rocking horse may be made of metal, wood, plastics or any other suitable material or any combination thereof. As mentioned before, the configuration may be in the shape of any other animal such as a donkey, elephant, deer, swan or the like.

The guide bar is preferably screw-threaded with two stop nuts longitudinally shiftable thereon, in order to change the rocking angle between a maximum for bigger children and a minimum for smaller children. Instead of helical springs, rubber buffers or pneumatic cushions may be employed as dampers.

The weights at the lower ends of the pendulum are interchangeable, a preferred kind of weights being a plurality of thin metal discs, any number of which can be placed on outwardly extending pins and retained there by split pins and washers.

It will be understood that it is feasable to fasten only one weight to one side of the pendulum.

The several parts of the rocking horse are preferably designed for quick assembly and disassembly, enablig its ready transport from site to site, even taking it on excursions. The stationary part is preferably mounted on a relatively small bottom plate which can be bolted to a solid floor, or on a large heavy plate which will support the entire horse without being bolted to the ground, for instance in a garden, without the danger of the toy's toppling over.

SHORT DESCRIPTION OF THE DRAWINGS

DESCRIPTION OF A PREFERRED EMBODIMENT OF THE ROCKING HORSE

Figure 1:
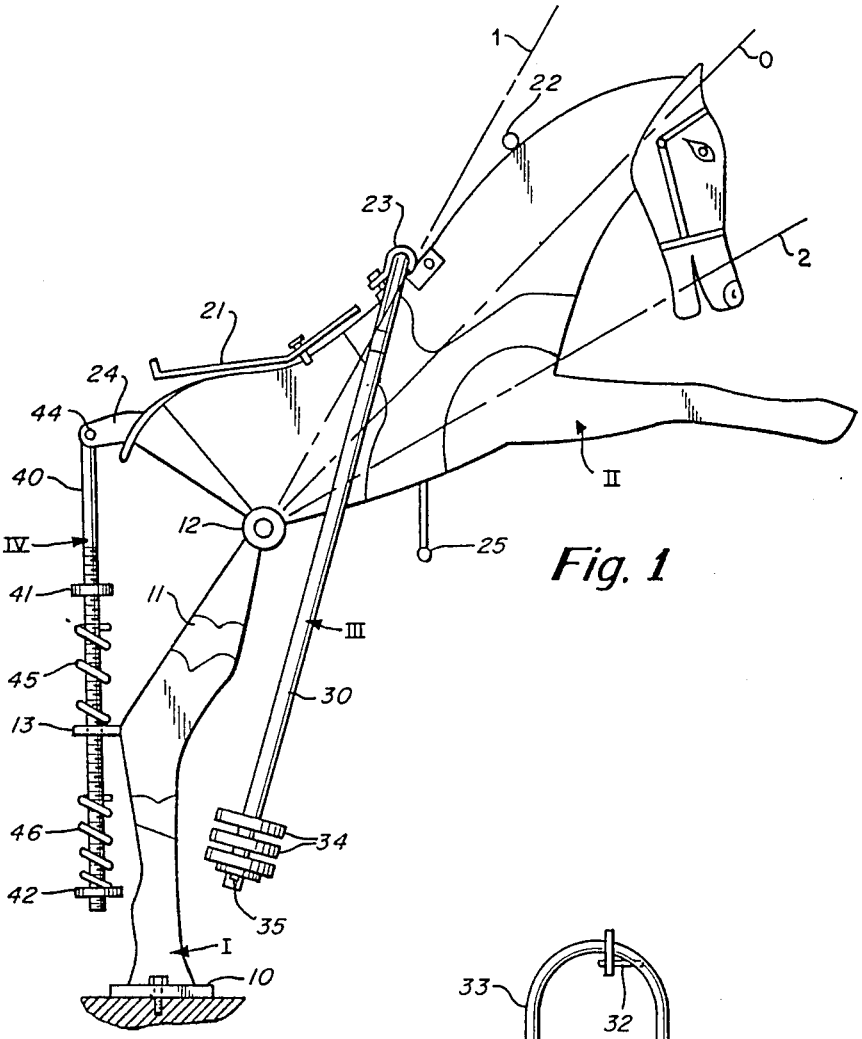
FIG. 1 is a side elevation of a rocking horse.
Figure 2:
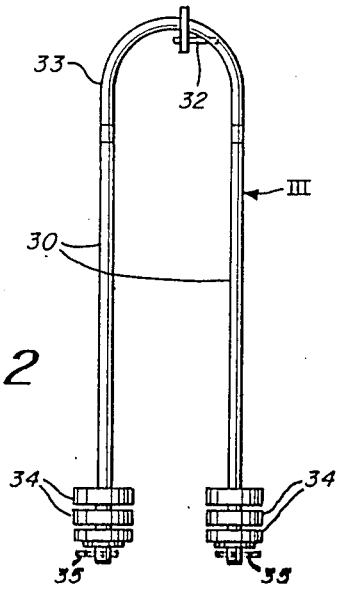
FIG. 2 is a side view of the pendulum illustrated in FIG. 1, showing the attachment of weights to the footholds.

The rocking horse according to FIG. 1 consists essentially of a stationary part I, representing the hind legs , a rocking part II representing the rump, the head and the forelegs of the horse, a weighted pendulum III, in the form of footholds or stirrups, and a guide bar IV.

The stationary part comprises a bottom plate 10 provided with holes for securing it to the ground by bolts or anchors. An upstanding post 11 in the shape of a hindleg is, at its lower end, firmly attached to the bottom plate 10, while its top end is fastened to the rocking part II by a pivot 12 which preferably consists of a pin supported by ball bearings. A horizontal, vertically perforated lug 13 is fixedly attached to the rear of the hindleg, about halfway between plate 10 and pivot 12, the lug serving as guide and stop for the resilient braking and stopping means fixed on the guide bar IV.

The rocking part II is pivotally attached to the stationary part I by means of the pivot 12, as well as limited in its rocking angle by the braking and stopping means on the guide bar. The rocking part contains a saddle 21 for seating the child thereon, a cross bar 22 serving as handhold for the child's hands, and a bar 25 serving as foothold. It further contains a bearing 23 for the pivotal suspension of the pendulum III, and a rearward extending tail 24 serving for pivotally connecting the rear end of the rump to the guide bar IV.

The pendulum III consists of a bar 30 bent into the shape of an inverted U. The upper end of the pendulum is cylindrical and is held in the bearing 23 on top of the horse's rump, there being provided a stop 32 to hold it in upright position. A number of discs 34 are lined up on the arms of the "U" and are prevented from dropping off by means of split-pins and washers 35. They form the balance weights serving the rock the rocking part to and fro by the movement of the pendulum in forward and rearward direction.

The guide bar IV comprises a substantially vertical round bar 40 which is attached to the tail lug 24 by a pin 44 and slidingly held in the hole of the lug 13. The bar is preferably screw-threaded, and two flat stop nuts 41 and 42 are movably fastened to the upper and the lower bar portion. Two helical springs 45 and 46 are slidingly movable on the bar, the upper spring 45 being positioned between the stop nut 41 and the lug 13, and the spring 46 between the top nut 42 and the lug 13. The springs serve to dampen the sudden stopping action of the stop nuts which otherwise would jolt the child.

The child seated on the saddle 21 moves the pendulum by movement of his body in forward and rearward direction; in the position shown in FIG. 1 the pendulum is in its rearward position, which will cause the rump to be tilted from its median position "0" to its maximum inclination as expressed by the mark "1". Owing to this movement, the guide bar will move in downward direction, until the nut 41 contacts and compresses the spring 45. Now, when the pendulum swings forward, the weights will lower the horse and the child down to the position "2". The pendulum will swing back by its inertia, and the horse will again rise to the position "1". The extent of the rocking motion can be altered by changing the position of the nuts on the bar 40, a larger distance between the nuts allowing a larger swinging motion, and vice versa.

It will be understood that the embodiment illustrated and described hereinbefore should serve as an example only, and that variations and modifications of the rocking horse may be carried out by a person skilled in the art, within the spirit of the invention and the scope of the appended claims.

It is, for instance, proposed to position the pivot of the pendulum at a lower point on the horse's rump than shown, as for example, underneath the belly.

Holes may be provided in the head portion for the attachment of reins.

The rump and the extremities may be in flat shape, or they may be fully fashioned so as to imitate an animal in every respect. In addition, a tail and/or a mane may be attached, these items not being shown in the present drawing in order to keep its mechanical parts as clear as possible.

I claim:

1. A children's toy in the form of a rocking horse or other animal, comprising:

a stationary part defining the hind leg or legs of said animal, positioned on the ground;

a rockable part defining the rump, the head and the forelegs of said animal, attached in its rear portion to the top portion of said stationary part by means of a pivot and adapted to swing about said pivot in a vertical plane by a predetermined angle;

a weighted pendulum attached to said rockable part by a pivot permitting its swinging motion in a plane parallel to the plane of said rockable part; and a guide bar pivotally attached to the tail end of said rump and slidingly movable in guide means on said stationary part, said guide bar being provided with adjustable stops adapted to limit the rocking motion of said rockable part by a predetermined angle.

2. The rocking horse of claim 1, comprising a saddle seat attached to the rump of said animal.

3. The rocking horse of claim 1, wherein said guide bar consists of a screw-threaded bar guided in a perforated lug on said stationary part, and containing one stop nut and one helical spring each lined up on each side of said lug, said springs serving to brake the rocking motion of the rockable part.

4. The rocking horse of claim 1, wherein said pendulum is in the shape of an inverted "U", is pivotally held in a bearing on the back of said rump, and is provided at its two bottom ends with disc-shaped weights.

5. The rocking horse of claim 1, comprising a cross bar on the back of said animal serving as handhold.

6. The rocking horse of claim 1, wherein said stationary part includes a perforated base plate permitting bolting of said stationary part to a floor.

7. The rocking horse of claim 1, wherein said stationary part includes a large heavy baseplate permitting placing said stationary part on the ground.

8. The rocking horse of claim 1, characterized by that its parts are designed for ready assembly and disassembly.

* * * * *